US008010021B2

(12) United States Patent
Joo

(10) Patent No.: US 8,010,021 B2
(45) Date of Patent: Aug. 30, 2011

(54) DEVELOPING CARTRIDGE HAVING A PLURALITY OF DEVELOPERS WITH DIFFERENT MATERIAL PROPERTIES AND IMAGE FORMING APPARATUS HAVING THE SAME

(75) Inventor: Jong-hwa Joo, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 950 days.

(21) Appl. No.: 11/869,153

(22) Filed: Oct. 9, 2007

(65) Prior Publication Data

US 2008/0193160 A1 Aug. 14, 2008

(30) Foreign Application Priority Data

Feb. 9, 2007 (KR) ..... 10-2007-0013864

(51) Int. Cl.
*G03G 15/08* (2006.01)

(52) U.S. Cl. ..... 399/259; 399/119; 399/262

(58) Field of Classification Search ..... 399/259, 399/119, 262; 430/123.54
See application file for complete search history.

(56) References Cited

U.S. PATENT DOCUMENTS 4,862,213 A * 8/1989 Ichihara et al. ..... 399/58
5,383,009 A * 1/1995 Tsusaka ..... 399/111
2003/0002884 A1* 1/2003 Yamada et al. ..... 399/106
2009/0285606 A1* 11/2009 Masui ..... 399/259

FOREIGN PATENT DOCUMENTS

JP 57-132161 8/1982
JP 4-309977 11/1992
JP 2002-240406 8/2002
JP 2006-119672 5/2006
JP 2007093872 A * 4/2007

OTHER PUBLICATIONS

English Abstract of JP 2007093872A, published Apr. 2007.*
Machine Translation of JP 2007093872A, published Apr. 2007.*
JP 2007093872A, published Apr. 2007.*
Korean Office Action issued Jun. 24, 2011 in KR Application No. 10-2007-0013864.

* cited by examiner

*Primary Examiner* — David P Porta
*Assistant Examiner* — Bryan P Ready
(74) *Attorney, Agent, or Firm* — Stanzione & Kim, LLP

(57) ABSTRACT

A developing cartridge includes an image receptor which spreads developer on a printing medium, a developer storing part which stores a plurality of developers having a different material property and a different supplying order according to the concerned material property, and a developer feeding unit which sequentially transfers each of the developers to the image receptor according to the supplying order.

29 Claims, 7 Drawing Sheets

DEVELOPING CARTRIDGE HAVING A PLURALITY OF DEVELOPERS WITH DIFFERENT MATERIAL PROPERTIES AND IMAGE FORMING APPARATUS HAVING THE SAME

CROSS-REFERENCE TO RELATED APPLICATIONS

This application claims priority from Korean Patent Application No. 10-2007-0013864, filed on Feb. 9, 2007 in the Korean Intellectual Property Office, the disclosure of which is incorporated herein by reference in its entirety.

BACKGROUND OF THE INVENTION

1. Field of the Invention

The present general inventive concept relates to a developing cartridge and an image forming apparatus including the same, and more particularly, to a developing cartridge having a plurality of developers having different printing characteristics and an image forming apparatus including the same.

2. Description of the Related Art

In general, an image forming apparatus is provided with a photosensitive body in which an electrostatic latent image is formed, a developing unit which develops developer on the photosensitive body, and a transferring unit which transfers the developer developed on the photosensitive body to a printing medium, which is called an electrophotographic image forming apparatus. The electrophotographic image forming apparatus includes a printer, a photocopier, and a multi-function printer.

FIG. 1 is a schematic view illustrating a configuration of a developing cartridge 20 used for a conventional image forming apparatus 10. The developing cartridge 20 is detachably provided in the image forming apparatus 10. The developing cartridge 20 is consumable to be replaced with a new one if the developer stored inside is used up. The developing cartridge 20 includes an electrifying part 23 which electrifies an image receptor 21 to a predetermined electric potential, the image receptor 21 on a surface of which an electrostatic latent image is formed by exposure of an exposure part (not shown) after it is electrified to the predetermined electric potential through the electrifying part 23, a developer feeding unit 25 which is in contact with the image receptor 21 and spreads the developer on the electrostatic latent image on the surface of the image receptor 21, a supplying part 28 which supplies the developer to the developer feeding unit 25, a developer regulating member 27 which regulates the amount of the developer supplied to the developer feeding unit 25, and a developer storing part 29 in which the developer is stored.

The developing cartridge 20 is traded and distributed independently from the image forming apparatus 10. Here, the developing cartridge 20 goes through various environment experiments not to generate a storage problem on the way of distribution after it is produced. That is, a storage condition inside the developing cartridge 20 is experimented by changing a package condition, humidity, temperature, and so on. Also, a process for adjusting ingredients included in the developer is performed according to the experiment result.

In the conventional developing cartridge 20, a ratio of a high polymer resin forming the developer through the above adjusting process is increased to improve the storage property of the developer stored inside during its distribution. However, in a case that the ratio of the high polymer resin is increased, the durability of the developer improves, but there may be a problem that a fusing quality and brilliance in a color image are deteriorated. Also, there is a problem that the fusing quality is more deteriorated in a case of an image forming apparatus performing a speed-up printing.

Meanwhile, in a case that the ratio of a low polymer resin included in the developer increases so as to improve the fusing quality and the brilliance in the color image, a glass transition temperature of the developer lowers and the developer is deteriorated during its distribution, thereby lowering its storage property.

In addition, in the conventional developing cartridge 20 storing the developer in which the ratio of the low polymer resin has increased, the developer is held in a nip N between the developer regulating member 27 and the developer feeding unit 25 in the distributing process after manufactured, and the developer held in the nip N is deteriorated under a high temperature environment to be attached to a surface of the developer regulating member 27. The developer attached to the developer regulating member 27 can not be restored to its original property to remain on the surface of the developer regulating member 27 even after the developing cartridge 20 is mounted to the image forming apparatus 10.

If the developer regulating member 27 in which the developer is attached is used to form an image, a streak "a" illustrated in FIG. 2, and a migration "b" illustrated in FIG. 3 are generated on the printed image, thereby deteriorating a printing quality.

The streak "a" is generated by an effect of the developer attached to the developer regulating member 27 and is formed in a proceeding direction of a printing medium if an image is formed. Also, the migration "b" is generated by an effect of the developer attached to the developer feeding unit 25 and is formed in a horizontal direction with respect to the proceeding direction of the printing medium in a rotational cycle of the developer feeding unit 25.

SUMMARY OF THE INVENTION

The present general inventive concept provides a developing cartridge capable of preventing the deterioration of a printing quality caused by a deteriorated developer during an its distribution or handling, and an image forming apparatus including the same.

Additional aspects and utilities of the present general inventive concept will be set forth in part in the description which follows and, in part, will be obvious from the description, or may be learned by practice of the present general inventive concept.

The foregoing and/or other aspects of the present invention can also be achieved by providing a developing cartridge including a casing to contain a plurality of developers having different properties, and having a plurality of storages to contain corresponding ones of the plurality of developers The plurality of developers may have mutually different internal additives and the same external additive.

The casing may include a partition to partition an inside of the casing into the storages, and the partition is removably coupled to the casing.

The developers having the different properties may be used to form a single color image.

The different properties of the developers may include different material properties to correspond to a single color of an image.

The developing cartridge may further include an image receptor which spreads the developers on a printing medium.

The developing cartridge of claim 6, wherein the developers are transferred to the image receptor to form a single color image.

The different properties of the developer may be different material properties to define a same color on the image receptor.

The casing may include a developer feeding part to feed the developers to the image receptor, and a developer regulating unit to regulate the developers on the developer feeding part, and the storages may be disposed to separate the developers such that one of the developers is separated from the developer regulating unit to prevent at least one of a streak and a migration.

The casing may include a developer feeding part to feed the developers to the image receptor, and the storages may be disposed in a supplying order with respect to the developer feeding part such that the developer feeding part supplies the developers in the supplying order to prevent at least one of a streak and a migration.

The different properties may be material properties each having a glass transition temperature; and the developers having a higher glass transition temperature may be transferred to the image receptor in a prior order.

A difference of the glass transition temperature between the developer supplied in the prior order and the developer supplied in a posterior order may be higher than 3° C.

The developing cartridge may further include a developer feeding unit to sequentially transfer each of the developers to the image receptor according to the supplying order, and a supplying part which is provided on one side of the casing and supplies the plurality of developers to the developer feeding unit, the developers may be disposed in a supplying order according to the different properties, and the developer supplied in the prior order may be disposed to be more adjacent to the supplying part.

The developing cartridge may further include a developer storing part supported by the casing and having a partition which partitions the plurality of developers to be stored in corresponding ones of the storages.

The partition may be extendedly formed to the outside of the casing.

The casing may include a partition accommodating slit which exposes an area of the partition to the outside of the casing.

The partition may be coupled to the casing to be removed through the partition accommodating slit by a predetermined drawing force.

The partition accommodating slit may be provided in an upper surface or a side surface of the casing.

The partition may be provided as a thin film.

The developers may be disposed in the corresponding storages of the casing in a supplying order according to the different properties.

The developing cartridge may further include an image receptor to spreads the developers on a printing medium, and a developer feeding unit to sequentially transfer each of the developers from the casing to the image receptor according to a supplying order.

The developing cartridge may further include an image receptor to spreads the developers on a printing medium, a developer feeding unit to transfer the developers to the image receptor according to a supplying order, and a supplying part provided on one side of the casing to supply the developers to the developer feeding unit.

The developers may include a first developer and a second developer, the storages may include a first storage and a second storage to contain the first developer and the second developer, respectively, and the supplying part may be disposed in one of the first storage and the second storage.

The casing may include a partition disposed between the first storage and the second storage to separate the first developer and the second developer.

The casing may include a developer regulating part disposed between the developer feeding part and the supplying part to regulate the developers on the developer feeding part, and the developer regulating part and the partition may define one of the first storage and the second storage.

The developer regulating part may be fixedly connected to the casing, and the partition may not be fixedly connected to the casing but removable from the casing.

The developing cartridge may further include an agitating unit disposed in one of the storages to agitate at least one of the developers, and the supplying part may be disposed in the other one of the storages The foregoing and/or other aspects of the present general inventive concept can be achieved by providing a developing cartridge, including an image receptor which spreads developer on a printing medium, a developer storing part which stores a plurality of developers having different material properties and a different supplying order according to the different material properties, and a developer feeding unit which sequentially transfers each of the developers to the image receptor according to the supplying order.

The foregoing and/or other aspects of the present invention can also be achieved by providing an image forming apparatus, including; a main body casing; a paper feeding part which is provided in the main body casing and feeds a printing medium; a developing cartridge which is detachably provided in the main body casing and spreads developer on a printing medium supplied from the paper feeding part; a transfer part which is provided on one side of the developing cartridge and transfers the developer to the printing medium; a fusing unit which fuses the developer to the printing medium by heat and pressure; and a discharging part which discharges the printed printing medium.

The foregoing and/or other aspects of the present invention can also be achieved by providing an image forming apparatus, including a main body casing, a paper feeding part which is provided in the main body casing and feeds a printing medium, a developing cartridge which is detachably provided in the main body casing and includes a casing to contain a plurality of developers having different properties, and a plurality of storages to contain corresponding ones of the plurality of developers, so that at least one of the plurality of developers is spread on the printing medium supplied from the paper feeding part, and a transfer part which is provided on one side of the developing cartridge and transfers the developer to the printing medium

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
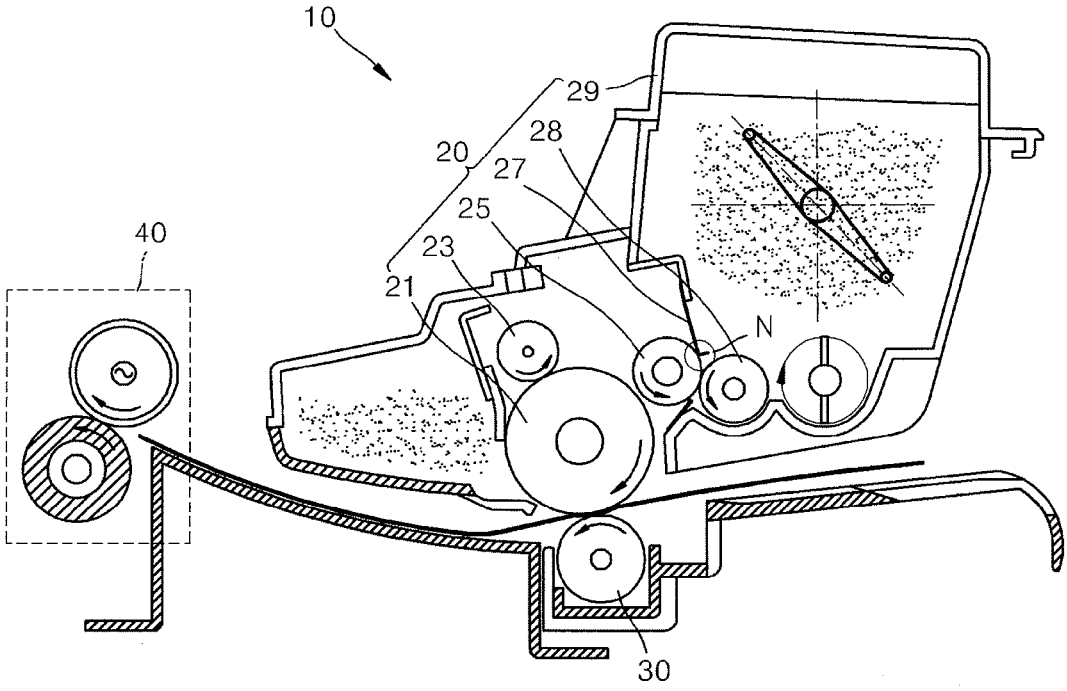
FIG. 1 (RELATED ART)
FIG. 1 is a schematic view illustrating a configuration of a conventional image forming apparatus.
Figure 2:
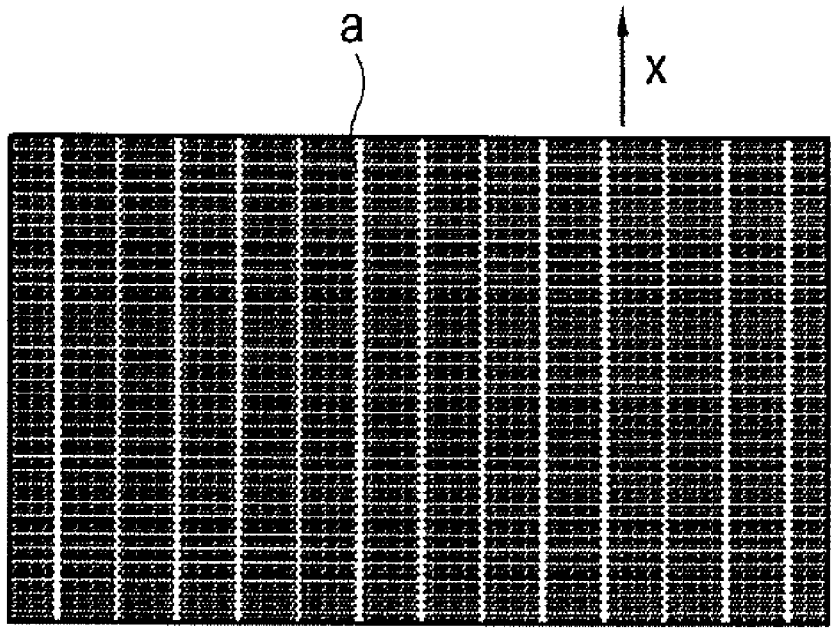
FIG. 2 (RELATED ART)
FIG. 2 is an exemplary view illustrating a migration generated when an image is formed in the conventional image forming apparatus of FIG. 1.
Figure 3:
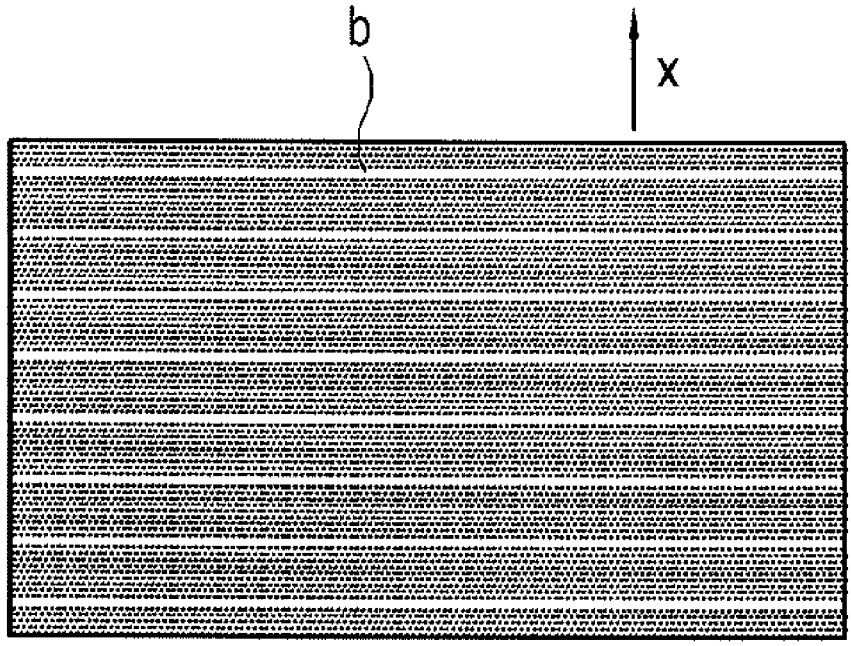
FIG. 3 (RELATED ART)
FIG. 3 is an exemplary view illustrating a streak generated when an image is formed in the conventional image forming apparatus of FIG. 1.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 4:
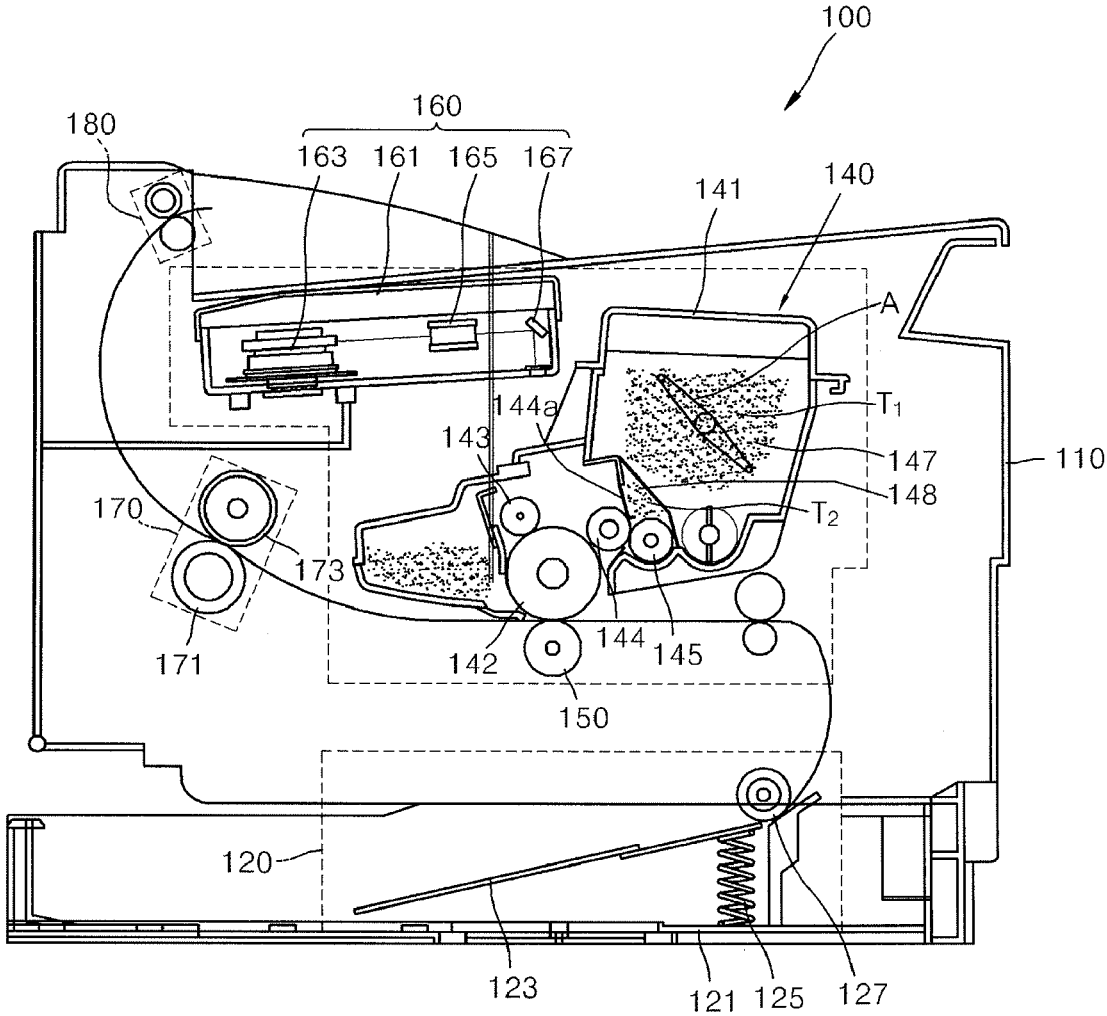
FIG. 4 is a schematic view illustrating an image forming apparatus according to an exemplary embodiment of the present general inventive concept.
Figure 5:
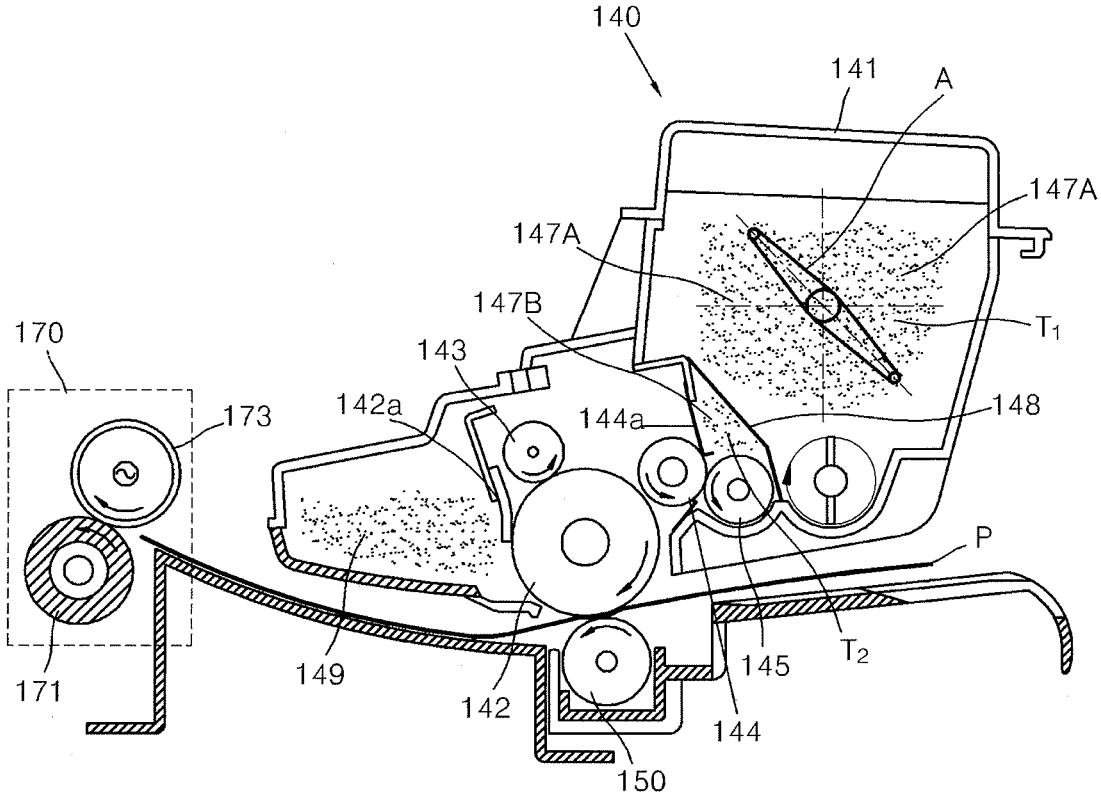
FIG. 5 is a schematic view illustrating a developing cartridge according to an exemplary embodiment of the present general inventive concept.

FIG. 4 is a schematic view illustrating an image forming apparatus 100 according to an embodiment of the present general inventive concept, and FIG. 5 is a schematic view illustrating a developing cartridge 140 according to an embodiment of the present general inventive concept.

Referring to FIGS. 4 and 5, the image forming apparatus 100 according to the present embodiment includes a main body 110, a paper feeding part 120 which is detachably provided in the main body 110 and supplies a printing medium P, a developing cartridge 140 which is detachably provided in the main body 110 and accommodates a plurality of developers T1 and T2 having different printing characteristics, a transferring part 150 which transfers the plurality of developers T1 and T2 to the printing medium, an exposure part 160 which scans light onto an image receptor 142 of the developing cartridge 140 to form an electrostatic latent image thereon, a fusing part 170 which fuses the developer transferred to the printing medium onto the printing medium by heat and pressure, and a discharging part 180 which discharges the printed medium to the outside.

The paper feeding part 120 supplies the printing medium toward the developing cartridge 140 and the transferring part 150. The paper feeding part 120 is separated from the main body 110 to refill a printing medium if the stored printing medium is used up, and is re-coupled to the main body 110 to supply the refilled printing medium. The paper feeding part 120 includes a cassette main body 121 which is detachably provided in the main body 110, a knock-up plate 123 on which a printing medium is loaded, a pick-up roller 127 which picks up the printing medium on the knock-up plate 123 to an outside of the knock-up plate 123, and an elastic member 125 which upwardly moves the knock-up plate 123 toward the pick-up roller 127. In general, the pick-up roller 127 applies a larger frictional force than that between the loaded printing media to the printing medium loaded uppermost to pick up the printing medium. At this time, on a lower side of the pick-up roller 127 is provided a friction member (not shown) to prevent an overlapped transfer of the printing medium.

The developing cartridge 140 is partitioned to store the plurality of developers T1 and T2 having different material properties, and the developers T1 and T2 are sequentially spread on the printing medium according to a supplying order corresponding to the material properties if the developing cartridge 140 is mounted to the main body 110. As illustrated in FIG. 5, the developing cartridge 140 includes a casing 141 which is mounted to and detached from the main body 110, the image receptor 142 which spreads the plurality of developers T1 and T2 on a printing medium, a developer storing part 147 in which the plurality of developers T1 and T2 having the different material properties are stored, a partition 148 which is provided in the developer storing part 147 to partition an inside of the casing into first and second storages 147A and 147B to contain corresponding one of the plurality of developers T1 and T2, a developer feeding unit 144 which transfers the plurality of developers T1 and T2 to the image receptor 142, and a supplying part 145 sequentially supplies the developers T1 and T2 to the developer feeding unit 144 according to the supplying order corresponding to the material properties. The developing cartridge 140 may include an agitating unit disposed one of the first and second storages to agitate and/or supply one of the developers T1 and T2, and the supplying part 145 may be disposed in the other one of the first and second storages.

The partition 148 separates the first and second storages 147A and 147B from each other to avoid mixing the plurality of developers T1 and T2. The partition 148 may be disposed along a line between an upper side and a bottom side of the casing 141 such that the first and second storages 147A and 147B are disposed opposite to each other in the casing with respect to the partition 148.

Here, the plurality of developers T1 and T2 may be a same color with the different properties. That is, the plurality of developers T1 and T2 may have the different properties or characteristics other than the same color.

Figure 6A:
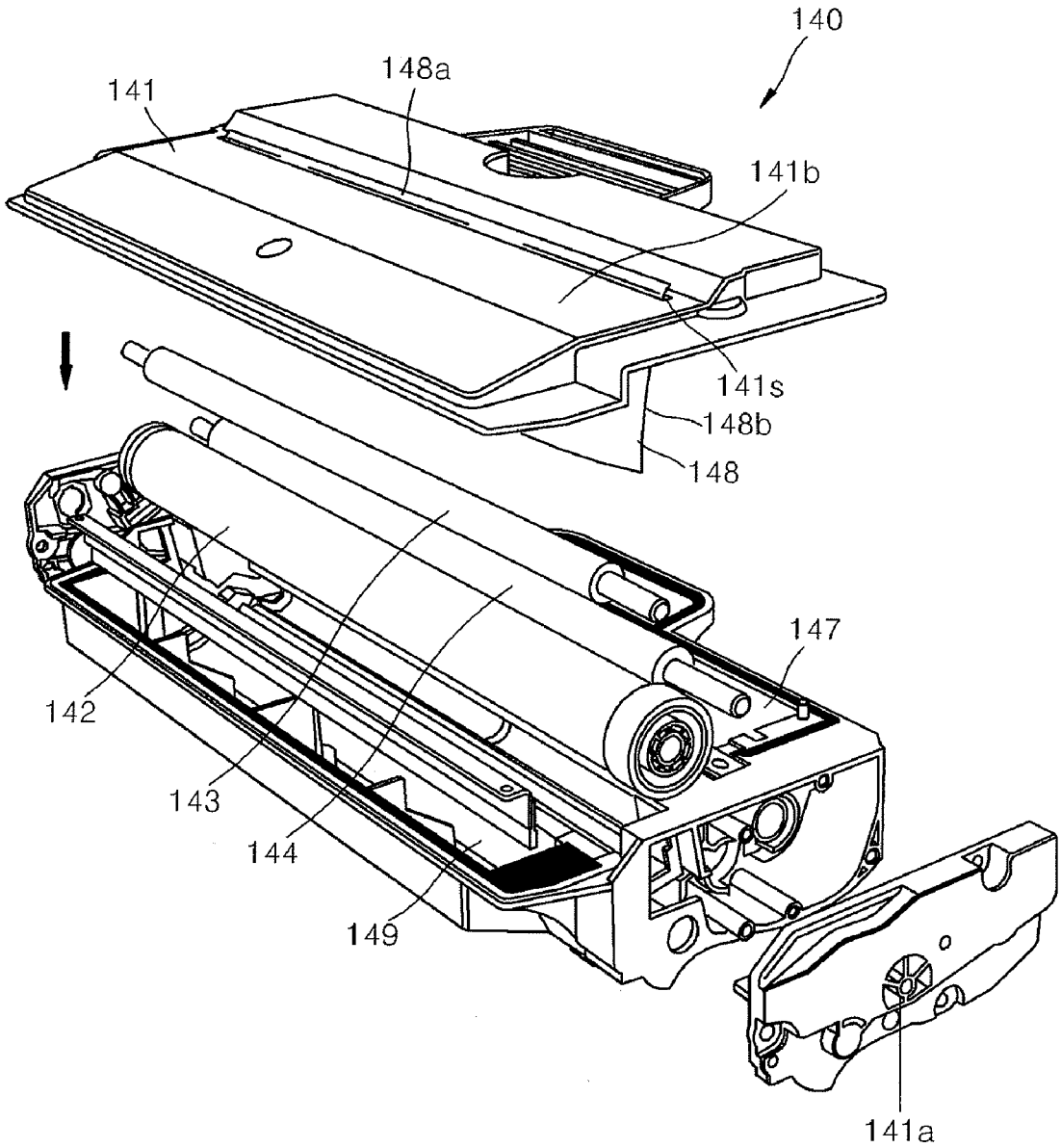
FIGS. 6A and 6B are exploded perspective views illustrating a developing cartridge according to an exemplary embodiment of the present general inventive concept.
Figure 6B:
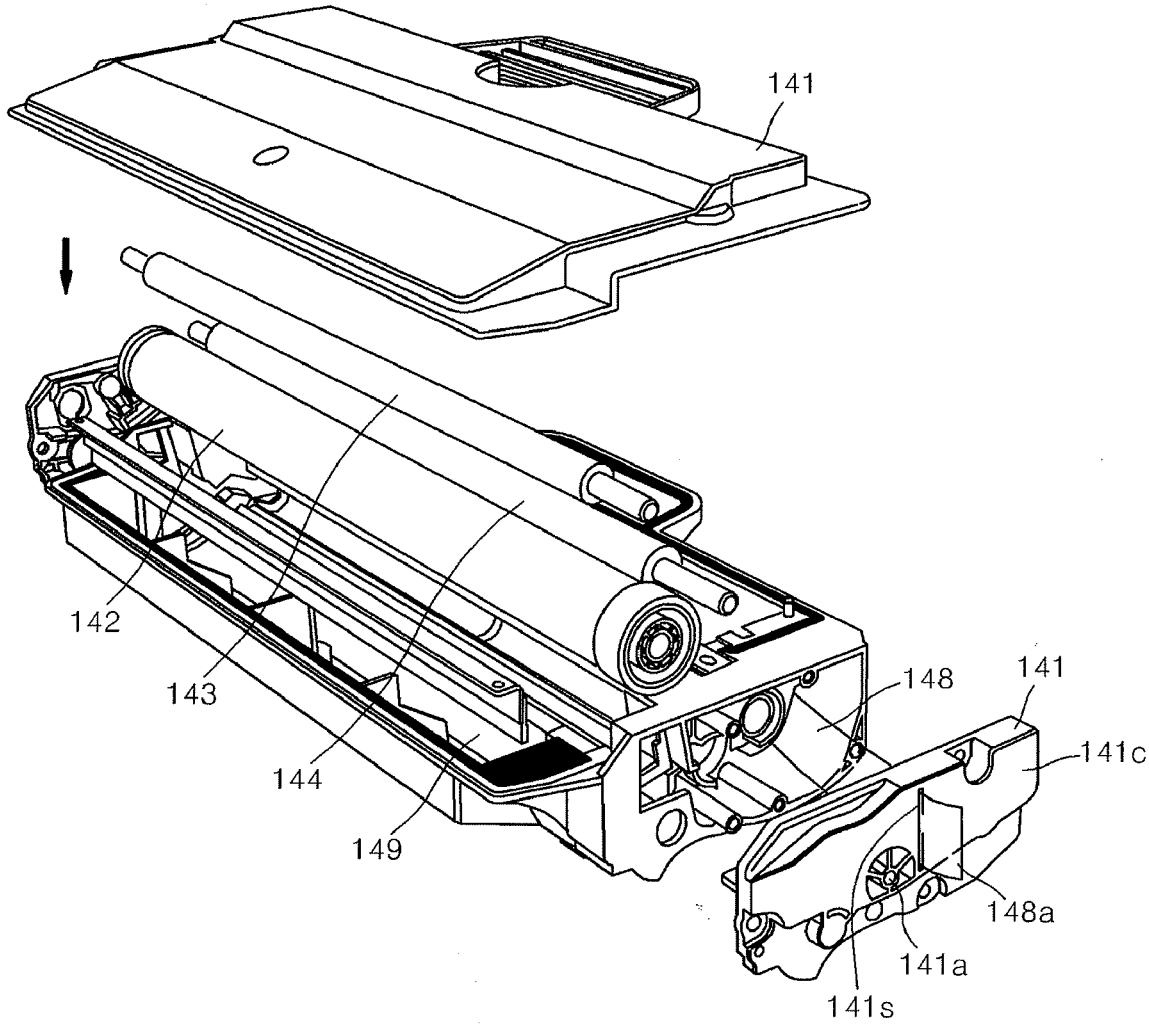

The casing 141 supports the image receptor 142 and the developer feeding unit 144, and protects each of the components from an external impact during a circulating (distribution) process of the developing cartridge 140 or the image forming apparatus 100 or during handling by a user before using the developing cartridge 140 to perform a printing operation in the image forming apparatus 100. As illustrated in FIGS. 6A and 6B, the casing 141 includes a driving part coupling part 141*a* which is coupled to a driving part (not shown) of the main body 110 to drive each of the components including the image receptor 142 and the developer feeding unit 144 if the casing 141 is mounted to the main body 110, and a partition accommodating slit 141*s* which exposes an area (an upper portion) 148*a* of the partition 148 partitioning the developer storing part 147 to an outside of the casing 141. Another area (portion) 148*b* of the partition 148 is extended from the area 148*a* to the inside of the casing 141 to divide the inside of the casing 141 into the first and second storages 147A and 147B. The driving coupling part 141*a* is coupled to the driving part (not shown) of the main body 110 to receive a driving force from the driving part and transfers the driving force to each of the components including the image receptor 142 if the casing 141 is mounted to the main body 110. The partition accommodating slit 141*s* exposes the area 148*a* of the partition 148 partitioning the developer storing part 147 so as to be recognized by a user. The partition accommodating slit 141*s* is provided to correspond to the length and the width of the partition 148.

As illustrated in FIG. 6A, the partition accommodating slit 141*s* may be provided in an upper side 141*b* of the casing 141 so that the user can remove the partition 148 by applying a drawing force to the area 148*a* of the partition 148 such that the partition 148 is removed from the upper side 141*b* through the partition accommodating slit 141*s* after mounting the casing 141 to the main body 110. Also, as illustrated in FIG. 6B, the partition accommodating slit 141*s* may be provided in a side 141*c* of the casing 141 so that the user can remove the partition 148 by applying a drawing force to the area 148*a* of the partition 148 such that the partition 148 is removed from the side 141*c* through the partition accommodating slit 141*s* before mounting the casing 141 to the main body 110. The partition accommodating slit 141*s* may be provided in another side of the casing 141 in consideration of a shape of the casing 141 and the disposition of each of the components. Also, if the number of the developers stored in the developer storing part 147 is greater than two, the partition accommodating slit 141*s* may be provided in plural according to the number of the partitions for partitioning the developers.

Meanwhile, the partition accommodating slit 141*s* may be covered by a predetermined protecting member (not shown) after the user removes the partition 148. The protector member (not shown) is provided to prevent a developer flowing due to a change of an internal pressure generated by rotation of an agitator A inside the developer storing part 147 from being leaked to the outside through the partition accommodating slit 141*s*. The protecting member (not shown) may be provided as a protecting tape to be attached to the upper side 141*b* or side 141*c* of the casing to seal the partition accommodating slit 141*s*.

The image receptor 142 spreads the plurality of developers T1 and T2 on the printing medium to form an image thereon. The image receptor 142 is provided by coating a photoconductive material layer on an external circumference surface of a cylindrical metal drum in a method such as deposition. The photoconductive material layer responds to light if the photoconductive material layer is exposed by the exposure part 160 and an electrostatic latent image corresponding to the image data is formed thereon.

An electrifying part 143 electrifies the image receptor 142 to a uniform electric potential. The electrifying part 143 rotates in contact or out of contact with an external circumference surface of the image receptor 142 to supply an electric charge and enables the external circumference surface of the image receptor 142 to have the uniform electric charge. For this purpose, the electrifying part 143 is applied with an electrified bias voltage by a power supplying part (not shown). The electrifying part 143 may be classified into a corona type which includes an electrifying wire and an electrifying shield provided not to contact with the image receptor 142 and electrifies the image receptor 142 to a predetermined electric potential by the corona discharge of the electrifying wire, and a roller type which rotates in contact with the image receptor 142 to electrify the image receptor 142 to a predetermined electric potential.

The developer feeding unit 144 sequentially transfers the plurality of developers supplied in a sequential order from the supplying part 145 to the electrostatic latent image of the image receptor 142. The developer feeding unit 144 is generally provided as a conductive rubber roller such as a compound material of an epichlorohydrin copolymer (ECO) and a synthetic rubber of a series of a nitrile butadiene rubber (NBR), a silicon rubber, an acrylic rubber, an urethane rubber, an ethylene propylene diene copolymerized rubber (EPDM), a butyl rubber, an epichlorohydrin rubber, a chloroprene rubber, or a raw rubber. The developer feeding unit 144 is applied with a developing voltage from the power supplying part (not shown) so as to spread the developer on its surface on the image receptor 142. Here, the developing voltage is provided to be higher than a surface voltage which the surface of the image receptor 142 has by the electrifying voltage of the electrifying part 143, and lower than the surface voltage of the electrostatic latent image exposed by the exposure part 160. Accordingly, the developer on the surface of the developer feeding unit 144 is attached to the electrostatic latent image of the image receptor 142 by a potential difference.

Meanwhile, on one side of the developer feeding unit 144 is provided a developer regulating member 144*a* applying a tangential pressure to the developer feeding unit 144 so that the developer supplied from the supplying part 145 can be spread on the surface of the developer feeding unit 144 in a uniform thickness. The developer regulating member 144*a* regulates the thickness of the developer layer spread on the developer feeding unit 144 thorough a bending angle of an area contacting with the developer feeding unit 144. Also, the developer feeding unit 144 frictionally electrifies the developer in contact with the developer of the developer feeding unit 144.

The supplying part 145 rotates and supplies a developer having a prior order (a higher priority) among the plurality of developers in the developer storing part 147 to the developer feeding unit 144 if a printing signal is applied. According to the order of the developers T1 and T2 disposed more adjacently to the supplying part 145, the supplying part 145 first supplies the developer T2 of the prior order to the developer feeding unit 144, and then supplies the developer T1 of a posterior order (a lower priority) to the developer feeding unit 144 after the first supplied developer T2 is transferred. The supplying part 145 is provided in a shape of a sponge or a brush to contact the developer and transfers the developer T1 and/or T2 by generating a static electricity to frictionally electrify the developer. Meanwhile, the supplying part 145 may be provided in plural in consideration of the size of the casing 141 and the distance between the developer storing part 147 and the developer feeding unit 144.

The developer storing part 147 stores the plurality of developers T1 and T2 having the different material properties. A single-ingredient developer including an internal additive having wax, coloring agent, charge control agent added to polyester resin, and an external additive such as silica and a metal oxide is used as the developer T1 and/or T2. The developer T1 and/or T2 varies in a material property, such as a developing characteristic, an electric resistance, a charge polarity, fluidity, a fixation property, a glass transition temperature according to the mixing ratio of the internal additive and the external additive, and the change of the material property causes a change of a printing characteristic.

The developer storing part 147 respectively partitions and stores the two developers having a different glass transition temperature. The glass transition temperature denotes a temperature in a state before the solid developer is transited into a liquid state if heat is applied to the solid developer. The developer storing part 147 according to an exemplary embodiment of the present invention includes a low temperature fusing developer T1 having a relatively low glass transition temperature, and a testing developer T2 having a relatively high glass transition temperature. The testing developer T2 is disposed in an area to contact with the developer feeding unit 144 and the developer regulating member 144*a* during the circulating period of the developer cartridge 140. The testing developer T2 has a glass transition temperature where the testing developer T2 is not deteriorated by the high temperature applied to the casing 141 not to be attached to the developer feeding unit 144 and the developer regulating member 144*a* during the circulating period in the market or during handling period by a user. Accordingly, a printing quality can be prevented from being deteriorated by the developer solidified in the developer feeding unit 144 and the developer regulating member 144*a* when the casing 141 is mounted to the main body 110.

The low temperature fusing developer T1 has a lower glass transition temperature in comparison with the testing developer T2. The low temperature fusing developer T1 may have a glass transition temperature being able to enhance a fixation property. The low temperature fusing developer T1 is stored to be distanced from the supplying part 144 in comparison with the testing developer T2 and is supplied to the developer feeding unit 144 through the supplying part 145 after the testing developer T2 is used up.

Here, a difference of the glass transition temperature between the low temperature fusing developer T1 and the testing developer T2 may be higher than 3° C. to prevent solidifying of the developer. Also, the glass transition temperatures of the low temperature fusing developer T1 and the testing developer T2 may be provided to be less than 60° C. in consideration of an initial fixation property of the developer.

Meanwhile, the glass transition temperature of the low temperature fusing developer T1 and the testing developer T2 may be changed by controlling a forming ratio of the internal additive and the external additive. That is, the glass transition temperature can be changed by controlling a compounding ratio of wax, coloring agent, charge control agent with the polyester resin included in the internal additive, or by controlling the ratio of the polyester resin. Also, the glass transition temperature can be changed by controlling a forming ratio of the external additive such as rica and a metal oxide material.

However, since the external additive determines an electrification efficiency of the developer, the low temperature fusing developer T1 and the testing developer T2 may be provided to have the same external additive, and only the internal additive may be provided to be different.

Meanwhile, since the testing developer T2 has an inferior fixation property in comparison with the low temperature fusing developer T1 to thereby deteriorate the printing quality, the testing developer T2 may be provided in a ratio of a small amount in the entire developer storing capacity. That is, the testing developer T2 may be provided in a small amount since it is used to prevent the developer feeding unit 144 and the developer regulating part 144*a* from contacting with the low temperature fusing developer T1 during the circulating period of the developer cartridge 140. The testing developer T2 may be provided to have the amount sufficient enough to be used up when the casing 141 first mounted to the main body 110 forms images on initial 30 sheets of printing media.

The table 1 illustrates the fixation property of the developer when images are formed on the 30 sheets of printing media in the case that the developer having the glass transition temperature of 56° C. is used for the testing developer T2, and the developer having the glass transition temperature of 51° C. is used for the low temperature fusing developer T1.

As shown in the table 1, the fixation property is improved after the 30 sheets of printing media are outputted as the capacity of the testing developer T2 is smaller with respect to capacities of the entire developer. Accordingly, the capacity of the testing developer T2 may be provided in a minimum ratio in consideration of the difference of the glass transition temperature between the two developers and the storing capacity of the entire developer storing part.

TABLE 1

| Testing developer (g) | Low temperature fusing developer (g) | Fixation property of the first printing medium (%) | Fixation property after outputting 30 sheets of printing media (%) |
|---|---|---|---|
| 5 | 95 | 77 | 97 |
| 10 | 90 | 77 | 95 |
| 15 | 85 | 77 | 93 |
| 20 | 80 | 77 | 91 |

Meanwhile, the developer storing part 147 includes the partition 148 which partitions the two developers having a different glass transition temperature. The partition 148 prevents the two developers from being mixed and solidified to be attached to the developer feeding unit 144 and the developer feeding regulating member 144*a* during the circulating period. The testing developer T2 is stored in an area 147B adjacent to the supplying part 145 with respect to the partition 148, and the low temperature fusing developer T1 is stored in an area 147A separated from the supplying part 145.

The partition 148 is coupled to the casing 141 so as to partition the two developers during the circulating period, and is removed from the casing 141 if the casing 141 is mounted to the main body 110. The one end part (i.e., area) 148*a* of the partition 148 is extendedly formed to the outside of the casing 141 for the user to easily remove. As illustrated in FIGS. 6A and 6B, the partition 148 is extended to an upper side 141*b* of the casing 141 or to a side 141*c* of the casing 141, and the area 148*a* thereof is exposed to the outside through the partition accommodating slit 141*a*. The partition 148 is attached to the casing 141 so as to be separated from the casing 141 in the case that the user applies a drawing force to the area 148*a* exposed to the outside. At this time, the adhesive force between the partition 148 and the casing 141 may be provided to be weak so as to be easily removed even by a small drawing force.

Meanwhile, the partition 148 may be provided of a material having a minimum volume since it takes a predetermined volume inside the developer storing part 147. Accordingly, the partition 148 is desirably provided of a thin film.

Meanwhile, the developer storing part 147 according to the exemplary embodiment of the present general inventive concept stores two developers having different material properties, but may be provided with a plurality of partitions 148 so as to partition each of the developers if three or more developers are stored, as necessary.

Meanwhile, the developer storing part 147 may include the agitator (not shown) which stirs the developers inside to supply the same to the supplying part 145.

Meanwhile, on one side of the image receptor 142 is provided a cleaning part 142*a* to clean a waste developer remaining on a surface of the image receptor 142 after transferring the developer onto the printing medium. The waste developer cleaned by the cleaning part 142*a* is stored in a waste developer storing part 149. The cleaning part 142*a* generally can employ a blade type which contacts with the image receptor 142 and cleans the waste developer on the surface of the image receptor 142, and a brush type which cleans the waste developer by a frictional force with the image receptor 142.

Meanwhile, on one side of the image receptor 142 may be further provided a charge eraser (not shown) for keeping electric potential on the surface of the image receptor 142 uniform after the cleaning process is completed by the cleaning part 142*a*. The charge eraser (not shown) is generally provided as a charge erasing lamp.

The transfer part 150 is provided to face the image receptor 142 and applies a predetermined transfer voltage to a rear surface of the printing medium to transfer the developer on the surface of the image receptor 142 to the printing medium. The transfer part 150 determines the thickness and resistance characteristics of the printing medium and is supplied with an optimum transfer voltage to apply the same to the rear surface of the printing medium. In general, the transfer part 150 applies a voltage having a polarity opposite to the polarity of the developer to enable the developer on the surface of the image receptor 142 to be transferred to the printing medium.

The exposure part 160 includes a light source part (not shown) which generates a light source, a polygon mirror 163, a reflection mirror 167, a plurality of optical holes 165 and a casing 161 which supports each of the components. The light source part (not shown) includes a light source (not shown) which generates and scans light, and a regulating lens (not shown) which regulates the scanned light to be parallel with an optical axis. The polygon mirror 163 is provided with a plurality of reflection faces to scan the light generated from the light source part (not shown) toward a sub-scanning direction. In general, the light source (not shown) may be provided as a plurality of laser diodes.

The fusing part 170 fuses the developer transferred from the image receptor 142 to the printing medium onto the printing medium by heat and pressure. The fusing part 170 includes a heating roller 171 which applies heat to the printing medium, and a pressing roller 173 which rotates to face the heating roller 171 and applies pressure to the printing medium. The description of a configuration of the fusing part 170 will be omitted as it is the same as the conventional configuration.

The discharging part 180 discharges the printed paper whose fusing is completed in the fusing part 170 to the outside. The discharging part 180 is provided as a pair of discharging rollers.

Hereinafter, an operating process of the image forming apparatus 100 with this configuration according to an exemplary embodiment of the present general inventive concept will be described by referring to FIGS. 4 through 6B.

First, the testing developer T2 may in contact with the developer feeding unit 144 and the developer regulating member 144*a* in the developing cartridge 140 during the circulating process or the handling process. At this time, the low temperature fusing developer T1 is stored, being partitioned from the testing developer T2 by the partition 148.

In the case that a high temperature is applied during the circulating process, the testing developer T2 is not transited due to its high glass transition temperature and is not attached between the developer regulating member 144*a* and the developer feeding unit 144.

When the developing cartridge 140 is mounted to the main body 110 of the image forming apparatus 100 by the user, the user draws out the area 148*a* of the partition 148 exposed to the outside of the casing 141 to remove the partition 148 from the casing 141. At this time, the partition 148 is drawn out through the partition accommodating slit 141*s* of the casing 141.

If the initial printing signal is applied, the supplying part 145 supplies the testing developer T2 disposed adjacent to the supplying part 145 to the developer feeding unit 144. Accordingly, the developer feeding unit 144 spreads the supplied testing developer T2 on the electrostatic latent image of the image receptor 142. The testing developer T2 spread on the image receptor 142 is transferred to the printing medium by the transfer voltage of the transfer part 150 to be fused on the printing medium by heat and pressure of the fusing part 170.

Meanwhile, as the partition 148 is removed, the low temperature fusing developer T1 is moved toward the supplying part 145 by the agitator A to be mixed with the testing developer T2 little by little. Also, if the testing developer T2 is used up, the low temperature fusing developer T1 is supplied to the developer feeding unit 144 to be spread on the printing medium.

As described above, the image forming apparatus according to the present invention stores a plurality of developers having a different glass transition temperature to differently control the developer contacting with the developer feeding unit and the developer regulating member during the distribution period and the practical printing process. Accordingly, the deterioration of the image quality generated by the developer attached to the developer feeding unit and the developer regulating member during the distribution period can be prevented.

Meanwhile, a mono type image forming apparatus has been described as an example in the above exemplary embodiment of the present invention, but it may be applied for a color type image forming apparatus using a plurality of developing cartridges.

Also, a plurality of developers having other different material properties may be stored other than the glass transition temperature, as necessary.

As described above, the developing cartridge and the image forming apparatus according to an exemplary embodiment of the present invention store a plurality of developers having a different glass transition temperature and supply developer having a high glass transition temperature to the developer feeding unit in a prior order to prevent deterioration of a printing quality including a streak and a migration in advance.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A developing cartridge comprising:

a casing to contain a plurality of developers having different material properties each having a glass transition temperature and a different supplying order according to the different material properties, and having a plurality of storages to contain corresponding ones of the plurality of developers, wherein at least one developer of the developers having a higher glass transition is transferred in a prior order.

2. The developing cartridge of claim 1, wherein the plurality of developers have mutually different internal additives and the same external additive.

3. The developing cartridge of claim 1, wherein;

the casing comprises a partition to partition an inside of the casing into the storages;

the partition is removably coupled to the casing.

4. The developing cartridge of claim 1, wherein the developers having the different properties are used to form a single color image.

5. The developing cartridge of claim 1, wherein the different properties of the developers comprise different material properties to correspond to a single color of an image.

6. The developing cartridge of claim 1, further comprising:

an image receptor which spreads the developers on a printing medium.

7. The developing cartridge of claim 6, wherein the developers are transferred to the image receptor to form a single color image.

8. The developing cartridge of claim 6, wherein the different properties of the developer comprises different material properties to define a same color on the image receptor.

9. The developing cartridge of claim 6, wherein:

the casing comprises a developer feeding part to feed the developers to the image receptor, and a developer regulating unit to regulate the developers on the developer feeding part; and the storages are disposed to separate the developers such that one of the developers is separated from the developer regulating unit to prevent at least one of a streak and a migration.

10. The developing cartridge of claim 6, wherein:

the different properties comprise material properties each having a glass transition temperature; and the developers having a higher glass transition temperature are transferred to the image receptor in a prior order.

11. The developing cartridge of claim 10, wherein a difference of the glass transition temperature between the developer supplied in the prior order and the developer supplied in a posterior order is higher than 3° C.

12. The developing cartridge of claim 10, further comprising:

a developer feeding unit to sequentially transfer each of the developers to the image receptor according to a supplying order; and a supplying part which is provided on one side of the casing and supplies the plurality of developers to the developer feeding unit, wherein the developers are disposed in the supplying order according to the different properties, and the developer supplied in the prior order is disposed to be more adjacent to the supplying part.

13. The developing cartridge of claim 1, further comprising:

a developer storing part supported by the casing and having a partition which partitions the plurality of developers to be stored in corresponding ones of the storages.

14. The developing cartridge of claim 13, wherein the partition is extendedly formed to the outside of the casing.

15. The developing cartridge of claim 14, wherein the casing comprises a partition accommodating slit which exposes an area of the partition to the outside of the casing.

16. The developing cartridge of claim 15, wherein the partition is coupled to the casing to be removed through the partition accommodating slit by a predetermined drawing force.

17. The developing cartridge of claim 16, wherein the partition accommodating slit is provided in an upper surface or a side surface of the casing.

18. The developing cartridge of claim 13, wherein the partition is provided as a thin film.

19. The developing cartridge of claim 1, wherein the developers are disposed in the corresponding storages of the casing in a supplying order according to the different properties.

20. The developing cartridge of claim 1, further comprising:

an image receptor that spreads the developers on a printing medium; and a developer feeding unit to sequentially transfer each of the developers from the casing to the image receptor according to a supplying order.

21. The developing cartridge of claim 1, further comprising:

an image receptor to spreads the developers on a printing medium;

a developer feeding unit to transfer the developers to the image receptor according to a supplying order; and a supplying part provided on one side of the casing to supply the developers to the developer feeding unit.

22. The developing cartridge of claim 21, wherein:

the developers comprise a first developer and a second developer;

the storages comprise a first storage and a second storage to contain the first developer and the second developer, respectively; and the supplying part is disposed in one of the first storage and the second storage.

23. The developing cartridge of claim 22, wherein the casing comprises a partition disposed between the first storage and the second storage to separate the first developer and the second developer.

24. The developing cartridge of claim 23, wherein:

the casing comprises a developer regulating part disposed between the developer feeding unit and the supplying part to regulate the developers on the developer feeding unit; and the developer regulating part and the partition define one of the first storage and the second storage.

25. The developing cartridge of claim 24, wherein:

the developer regulating part is fixedly connected to the casing; and the partition is not fixedly connected to the casing but removable from the casing.

26. The developing cartridge of claim 21, further comprising:

an agitating unit disposed in one of the storages to agitate at least one of the developers, wherein the supplying part is disposed in the other one of the storages.

27. The developing cartridge of claim 1, wherein a mixing ratio of an internal additive and an external additive of each developer determines the properties of each developer.

28. The developing cartridge of claim 27, wherein the internal additive includes a wax, a coloring agent, and a charge control agent added to polyester resin and the external additive includes silica or a metal oxide.

29. An image forming apparatus, comprising:

a main body casing;

a paper feeding part which is provided in the main body casing and feeds a printing medium;

a developing cartridge which is detachably provided in the main body casing and includes a casing to contain a plurality of developers having different material properties each having a glass transition temperature and a different supplying order according to the different material properties, and a plurality of storages to contain corresponding ones of the plurality of developers, so that at least one of the plurality of developers is spread on the printing medium supplied from the paper feeding part; and a transfer part which is provided on one side of the developing cartridge and transfers the developer to the printing medium, wherein at least one developer of the developers having a higher glass transition is transferred in a prior order.

* * * * *